United States Patent [19]

Wilson

[11] Patent Number: 4,669,342

[45] Date of Patent: Jun. 2, 1987

[54] TOOL HANDLE ATTACHMENT

[76] Inventor: Daniel J. Wilson, 402 S. Union, Spencerport, N.Y. 14559

[21] Appl. No.: 900,973

[22] Filed: Aug. 27, 1986

[51] Int. Cl.[4] ..... B25G 3/00

[52] U.S. Cl. ..... 81/489; 81/20

[58] Field of Search ..... 81/489, 492, 20, 22; 30/523, 524, 334; 16/DIG. 24, 110 R, 116 R; 403/209, 210, 211

[56] References Cited

U.S. PATENT DOCUMENTS

| | | | |
|---|---|---|---|
| 428,421 | 5/1890 | Shaw | 81/20 |
| 967,703 | 8/1910 | Basnall | 81/20 |
| 1,115,637 | 11/1914 | Willett | 16/116 R |
| 4,096,895 | 6/1978 | Fernitz | 81/20 |

*Primary Examiner*—Frederick R. Schmidt
*Assistant Examiner*—Judy J. Hartman
*Attorney, Agent, or Firm*—D. I. Hague

[57] ABSTRACT

A retaining device for connecting a tool head with a tapered eye to a tapered tongue of a tool handle. The retaining device includes two threaded, J-shaped bolts, a V-shaped plate having a hole in each leg for receiving the threaded portion of a J-bolt, and two hex nuts. The V-plate is positioned on the outer surface of the tongue with the J-bolts extending through the eye and latching a lower surface of the tool head. When the nuts are threaded onto the J-bolts and tightened, the J-bolts are drawn upwardly and radially outwardly, forcing the tool head into a secure, wedged engagement with the tool handle.

1 Claim, 3 Drawing Figures

TOOL HANDLE ATTACHMENT

BACKGROUND OF THE INVENTION

1. Field of the Invention

This invention relates in general to tool handle attachments and, in particular, to an improved device for securing a tool handle within the eye of a tool head.

2. Brief Description of the Prior Art

Conventionally, a wooden handle is attached to the head of an impact tool, such as an axe, pick, sledge hammer and the like, by inserting the tapered tongue of the handle into the tapered eye of the tool head. The end of the tongue is then spread open to engage the side walls of the eye by a wedge driven into the end of the tongue.

The tongues of fiberglass or metal handles cannot be satisfactorily spread with a wedge and thus cannot be attached to conventional tool heads in the conventional manner. Furthermore, the eyes in conventional tool heads may be provided with a single decreasing taper or with a double taper. This alternative eye construction coupled with the wide range of sizes of eye holes and handles makes it difficult to ensure secure engagement of replacement handles with various tool heads.

SUMMARY OF THE INVENTION

In accordance with the present invention an improved tool retaining member and method is provided which is capable of being used with wooden, fiberglass and metal handles and with a wide range of sizes of eye holes. To use the retaining member of the present invention, the handle grip portion distal the tongue is inserted through the tool eye. Two J-bolts are then inserted through the tool eye so that the J-shaped portions engage the lower eye rim on opposite sides of the handle. The tool head and bolts are then pushed onto the tongue portion so that the threaded end portions of the J-bolts extend beyond the tongue and the upper eye rim. The V-shaped seat is then inserted onto the J-bolts and nuts threaded thereon and tightened. As the nuts are tightened, the J-bolts are forced upwardly and radially outwardly securely wedging the handle and the tool head together. In a preferred embodiment of the invention, the tongue of the tool handle is provided with a pair of slots and a mating V-shaped seat which receive the J-bolts and V-seat of the retaining member, respectively. The slots and tongue V-seat cooperate with the retaining member to increase the effectiveness of the wedging action.

The invention and its features and advantages will become more apparent by reference to the accompanying drawings and the ensuing detailed description of the preferred embodiment of the invention.

DETAILED DESCRIPTION OF THE PREFERRED EMBODIMENT

Figure 1:
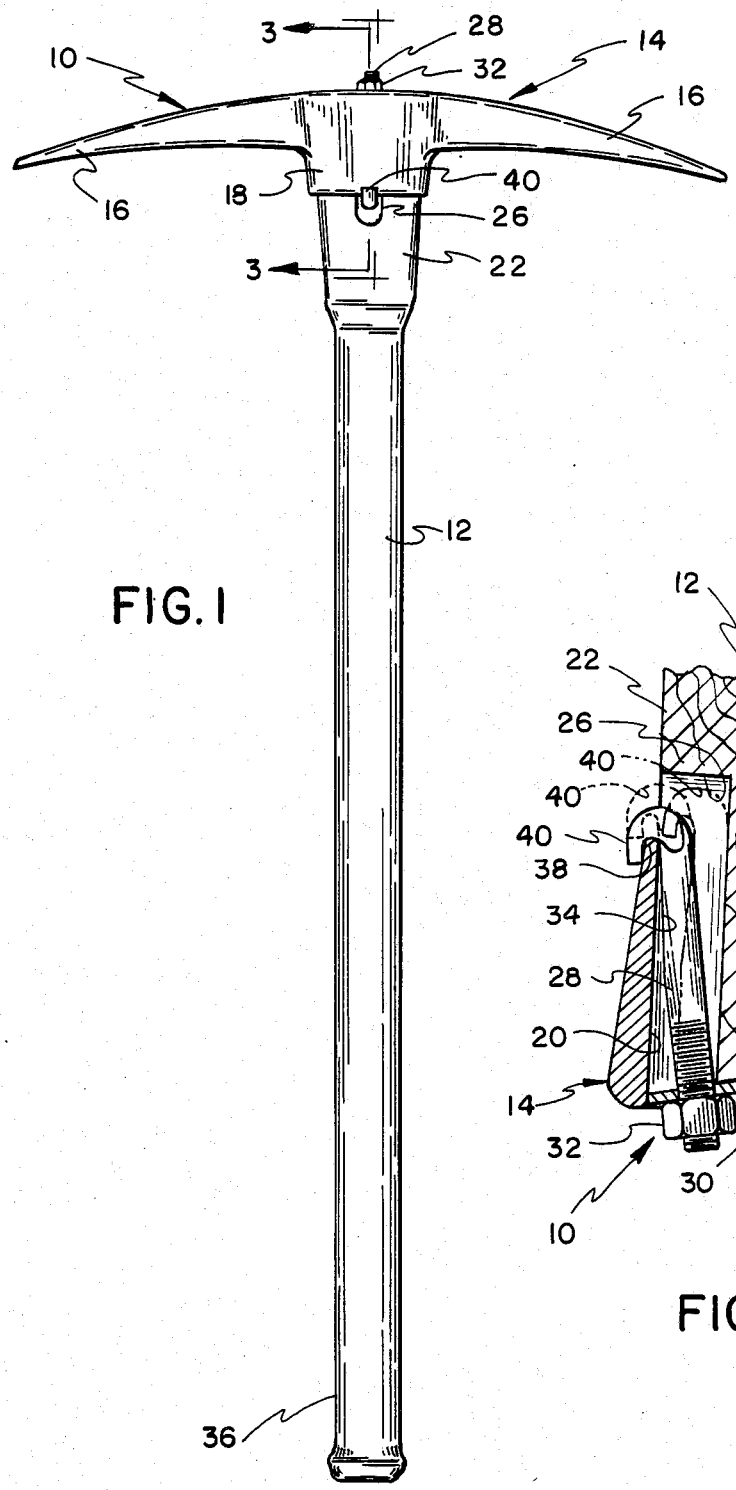
FIG. 1 is a side elevational view of a pick axe incorporating a retaining member made in accordance with the teachings of the present invention.

With reference now to the drawings, the present invention is embodied in an improved retaining member

10 for connecting a handle 12 to a tool head 14. The illustrative tool head 14 shown in the drawings is a pick axe, but it is to be understood that the attachment member of the present invention can be used with many types of tools, and in particular with impact tools, such as sledge hammers, axes, mauls and the like. The tool head 14 includes two striking or working portions 16, a handle mounting collar 18 and an eye 20 whose axis lies parallel to the planes of the collar 18. In the illustrative embodiment the internal surface of eye 20 has a decreasing single taper of elliptical or ovate cross section. The retaining member of the present invention may, however, be used with equal facility with tool heads provided with a double or "hour-glass" taper of venturi shape.

Figure 2:
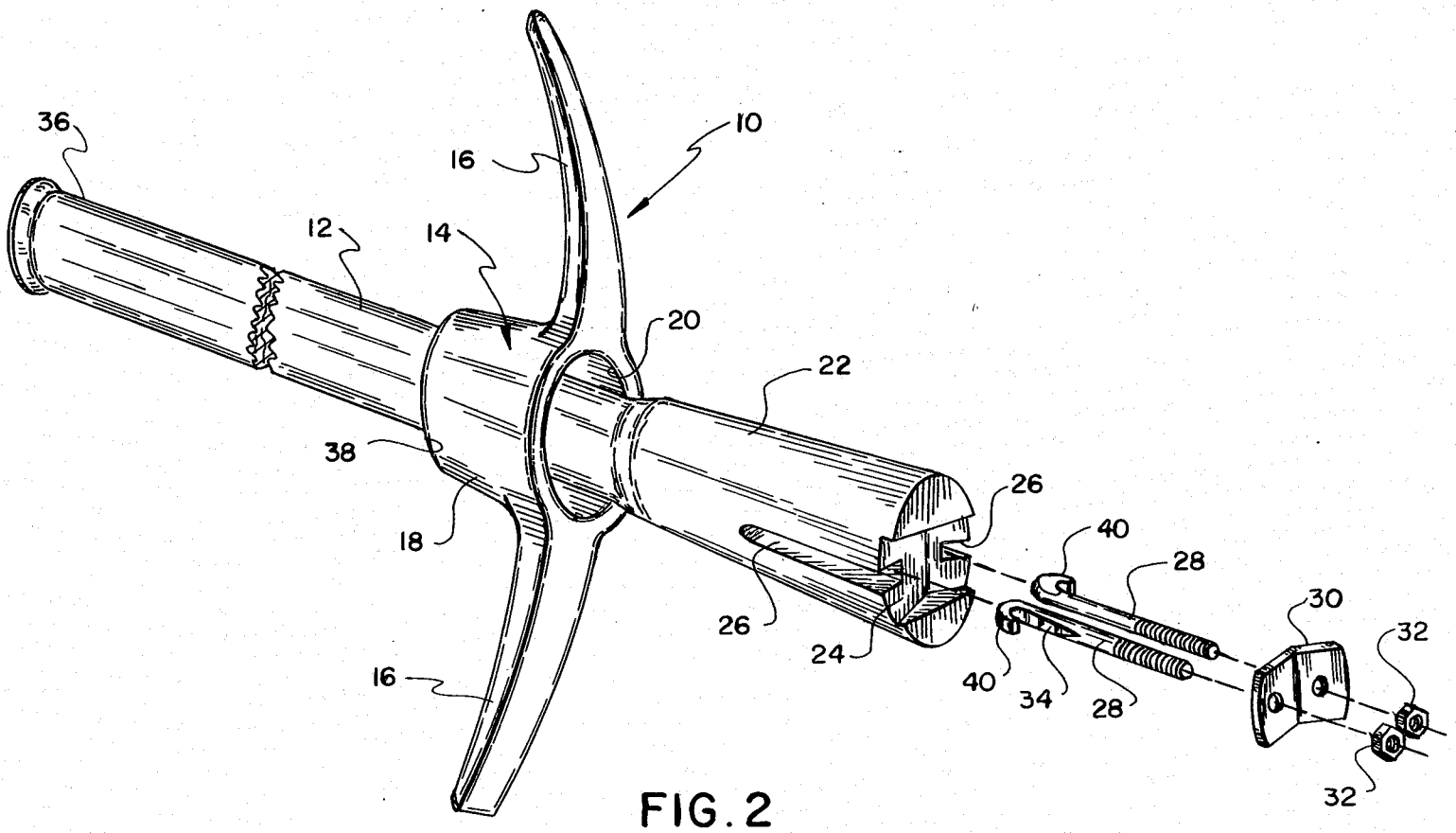
FIG. 2 is an exploded view of the pick axe illustrated in FIG. 1.

The elongated handle 12 has a grip portion 36 and a tongue 22 whose external surface has a decreasing single taper of elliptical or ovate cross section larger than that of the eye 20. In a preferred embodiment of the invention, the tongue 22 is provided with a V-shaped groove 24 in its free, upper or top surface as shown in FIG. 2 and two slots 26. As best shown in FIG. 2, the slots 26 are provided on opposite sides of the tongue 22 on the major axis of the ellipse and extend downwardly from each leg of the V-groove 24.

Figure 3:
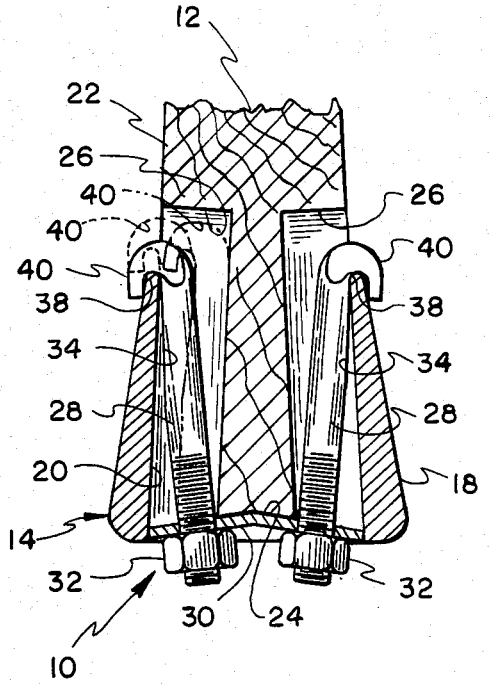
FIG. 3 is a sectional view taken substantially in the direction of the arrows 3—3 of FIG. 1.

The retaining member 10 includes two threaded, J-shaped bolts 28, a metal V-shaped plate 30 having a hole in each leg for receiving the threaded portion of a J-bolt 28 and 2 hex lock nuts 32. Preferably, as shown in FIGS. 2 and 3, a portion 34 of the shank of each J-bolt is ground flat so as to increase the area of contact between the J-bolts 28 and mounting collar 18.

In use, the J-bolts 28 are inserted into the tongue slots 26. The handle grip portion 36 distal the tongue 22 is then inserted through the eye 20 and the tool head 14 is pushed upwardly until the lower rim 38 of the mounting collar 18 moves past the latch portions 40 of the J-bolts 28. The J-bolts are then pushed outwardly as shown in dotted lines in FIG. 3 and the tool head pushed downwardly so that the lower rim 38 is received into the latch portions 40. The V-shaped plate 30 is inserted onto the upstanding J-bolt shanks and pushed downwardly into engagement with the mating V-groove 24 provided in the handle 12. The nuts 32 are then threaded onto the J-bolts 28 and tightened. As the nuts 32 are tightened, the latch portions 40 of the J-bolts are drawn upwardly and radially outwardly forcing the mounting collar 18 upwardly into secure frictional engagement with the tapered tongue 22. The shank flats 34 increase the area of contact between the J-bolts 28 and mounting collar 18 and thus increase the effectiveness of the wedging action between the collar 18 and tongue 22. The shank flats 34 also permit the retaining member 10 to be used with a greater range of sizes of eyes 20 and tool handles 12.

Advantageously, the tool head can be easily removed from the handle for storage or handle replacement by removing the nuts from the J-bolts and pushing the tool head downwardly away from the tapered tongue.

The invention has been described in detail with particular reference to a preferred embodiment thereof, but it will be obvious to those skilled in the art that various changes and modifications may be made therein without detracting from the invention and the invention is, therefore, intended to cover all such changes and modifications as fall within the true spirit and scope of the appended claim.

I claim:

1. In a tool comprising a head including an eye having a tapered internal surface, an elongated handle including a tongue having a tapered external surface, and a retaining device for securing the handle to the head, the improvement wherein:

(a) the retaining device comprises a pair of generally J-shaped bolts and a generally V-shaped plate having a hole extending through each leg of the plate, the V-plate being disposed abutting a free end of the tongue, the J-bolts having a first threaded portion extending upwardly through the V-plate holes, a second shank portion disposed within the eye, straddling the tongue, and including a flat surface abutting an internal surface of the eye, and a third latch portion engaging a surface of the head; and, (b) the tongue has a generally V-shaped groove in its free end adapted to receive the V-plate and a pair of longitudinally extending slots located on opposite sides of the tongue and adapted to receive the second portions of the J-bolts whereby said second portions are inclined in a longitudinal direction extending laterally outwardly and away from the tapered surface of the tongue.

* * * * *